United States Patent [19]

Martincic

[11] 4,199,743

[45] Apr. 22, 1980

[54] ENCAPSULATED CURRENT TRANSFORMER

[75] Inventor: Paul W. Martincic, Hermitage Township, Mercer County, Pa.

[73] Assignee: Westinghouse Electric Corp., Pittsburgh, Pa.

[21] Appl. No.: 875,670

[22] Filed: Feb. 6, 1978

[51] Int. Cl.[2] ..... H01F 15/02

[52] U.S. Cl. ..... 336/96; 29/605; 264/272

[58] Field of Search ..... 336/96, 205, 206, 207, 336/185, 198; 361/314, 323; 264/271, 272; 29/605, 606

[56] References Cited

U.S. PATENT DOCUMENTS

| | | | |
|---|---|---|---|
| 3,043,994 | 7/1962 | Anderson et al. | 336/96 X |
| 3,633,140 | 1/1972 | Lake et al. | 336/205 X |

*Primary Examiner*—Thomas J. Kozma
*Attorney, Agent, or Firm*—R. W. Smith

[57] ABSTRACT

A current transformer encapsulated in an injection molded layer of insulating material. The current transformer includes a secondary winding which is disposed around a winding spool having side flanges thereon. Permanent spacers extend across the length of the winding spool and rest on the side flanges such that the permanent spacers are spaced from the secondary winding. A primary winding is wound around the spacers so as to be spaced from the secondary winding before the encapsulating material is injection molded around the magnetic core and windings and into the space between the primary and secondary windings. The winding spool and permanent spacers are formed of a material which softens within the processing temperature range of the encapsulating material to form an amalgamation without a distinct interface between the encapsulating material and the winding spool and spacers. In another embodiment, a "through-type" current transformer has a toroidal-shaped magnetic core enclosed in a rigid sheath of solid material. A tubular member is disposed within the central opening of the magnetic core and secondary winding and is formed of a material which softens in the processing temperature range of the encapsulating material to form an amalgamation without a distinct interface therebetween such that a fluid-type seal is formed between the tubular member and the encapsulating material.

5 Claims, 6 Drawing Figures

ENCAPSULATED CURRENT TRANSFORMER

BACKGROUND OF THE INVENTION

1. Field of the Invention

This invention relates, in general, to electrical apparatus and, more specifically, to instrument current transformers, such as current transformers.

2. Description of the Prior Art

Instrument transformers, such as current transformers, are typically encapsulated in a thin layer of insulating material, such as butyl rubber or epoxy resin, in order to provide a weathertight seal around the current transformer. In encapsulating a current transformer, the assembled transformer is first placed in a suitable mold. The encapsulating material is then poured into the mold to fill all the cavities therein before being cured to a solid state. Although such encapsulating compounds provide satisfactory results, the encapsulating process is time consuming since it normally requires several hours to cure the encapsulating compounds, such as butyl rubber or epoxy resin, to a solid state. In addition, these types of encapsulating materials have become quite expensive.

It has been proposed to injection mold a layer of encapsulating material around electrical apparatus, such as current transformers. Such a process provides manufacturing advantages since the encapsulating materials can be hardened to a solid state in a matter of 2 to 3 minutes instead of the several hours associated with other types of molding materials. In an injection molding process, the encapsulating material is injected into a suitable mold containing the apparatus under extremely high pressures and temperatures. The high pressures involved in the injection molding process have heretofore prohibited the injection molding of an encapsulating material around current transformers. In a "through-type" current transformer having a secondary winding disposed in inductive relation with a toroidal-shaped magnetic core which has a central opening extending therethrough, the high pressures utilized in the injection molding process cause the shape of the magnetic core to be distorted and, further, cause the molding material to be extruded between the laminations of the magnetic core which affects the electrical performance of the transformer. In addition, it has been difficult to obtain an even coating of encapsulating material in the central opening of such current transformers. Various types of tubes or liners have been used within the central opening to provide insulation for the current transformer. However, it has been difficult to provide an adequate fluid-tight seal between such tubes or liners and the molding material. Mechanical seals, such as "O" rings, or adhesives have been used in the past; however, such means have proved to be costly and marginally effective in providing a fluid-tight seal between the liners and the molding material.

In current transformers of the type having primary and secondary windings concentrically disposed in inductive relation about a magnetic core, the problems involved in maintaining an adequate insulation space between the primary and secondary windings has prohibited the use of the injection molding process. In order to provide adequate dielectric strength between the primary and secondary coils, a certain minimum insulation clearance between the primary and secondary coils is required. However, due to manufacturing tolerances and the extremely high pressures used in the injection molding process, misalignment of the primary and secondary coils results which causes the major insulation clearance between the coils to be below the minimum required. As a result, an excess of insulation clearance would normally be designed into the current transformer. This causes the mean turn of the primary coil to be increased and results in a larger and more costly transformer.

Rod-like spacers have been utilized in prior art current transformers in order to prevent misalignment of the primary and secondary coils and thereby maintain a constant insulation clearance therebetween. However, the use of spacers made of standard insulating materials, such as fiberboard, cellulosic paper, fiberglass and "Micarta", do not adequately bond with the encapsulating material, which thereby results in an interface between the spacers and the encapsulating material which would form a short circuit path between the primary and secondary coils.

Thus, it would be desirable to provide an instrument transformer, such as a current transformer, suitable for encapsulation in an injection molded layer of insulating material. It would also be desirable to provide a current transformer in which the shape of a magnetic core is prevented from distorting under the high pressures involved in the injection molding process. It would also be desirable to provide a "through-type" current transformer wherein a fluid-tight seal is provided between a tubular liner in the central opening of the current transformer and the encapsulating material. It would also be desirable to provide the current transformer having primary and secondary windings in which the insulation clearance space between the primary and secondary windings is minimized and, further, is held constant despite the high injection molding pressures. It would also be desirable to provide a current transformer having spacer members disposed between the primary and secondary windings which are adequately bonded to the encapsulating material without an interface therebetween to eliminate short circuit paths between the primary and secondary winding.

SUMMARY OF THE INVENTION

Herein disclosed is a current transformer suitable for encapsulation in an injection molded layer of insulating material. In one embodiment, the current transformer includes a secondary winding disposed on a winding spool having side flanges. A plurality of permanent spacers extend across the length of the winding spool and rest on the side flanges so as to be spaced from the secondary winding. A primary winding is disposed around the permanent spacers so as to be spaced from the secondary winding before the current transformer is placed into a mold. Encapsulated material is then injected into the mold to encapsulate the magnetic core and windings and to fill the insulation clearance space between the primary and secondary windings. The insulation space between the primary and secondary windings is thus fixed and held constant despite the high pressures associated with the injection molding process. By fixing the insulation space and preventing misalignment between the primary and secondary windings, the insulation clearance space may be reduced over prior art current transformers which required an excess of insulation clearance to allow for misalignment of the coils.

The permanent spacers and winding spool are formed of a material that softens within the processing temperature range of the encapsulating material to form an amalgamation therebetween without a distinct interface between the encapsulating material and the permanent spacers and the winding spool which provides increased dielectric strength by eliminating the short circuit path between the windings that was present in prior art current transformers of this type.

In another embodiment, a "through-type" current transformer is provided in which the shape of the magnetic core is maintained constant despite the high pressures encountered in the injection molding process. A rigid coating of a hardened material, such as a cured thermoset resin surrounds the magnetic core to prevent distortion of the core and also to prevent the molding material from being extruded between the laminations of the magnetic core. In addition, a tubular liner is disposed within the central opening of the magnetic core and secondary winding assembly. The tubular liner is formed of a material that softens within the process temperature range of the encapsulating material to form an amalgamation without a distinct interface between the liner and the encapsulating material. The tubular liner, thus, forms a fluid-tight seal with the encapsulating material that has been difficult to obtain using prior art methods.

BRIEF DESCRIPTION OF THE DRAWINGS

The various features, advantages and other uses of this invention will become more apparent by referring to the following detailed description and the accompanying drawing in which.

DESCRIPTION OF THE PREFERRED EMBODIMENTS

Figure 1:
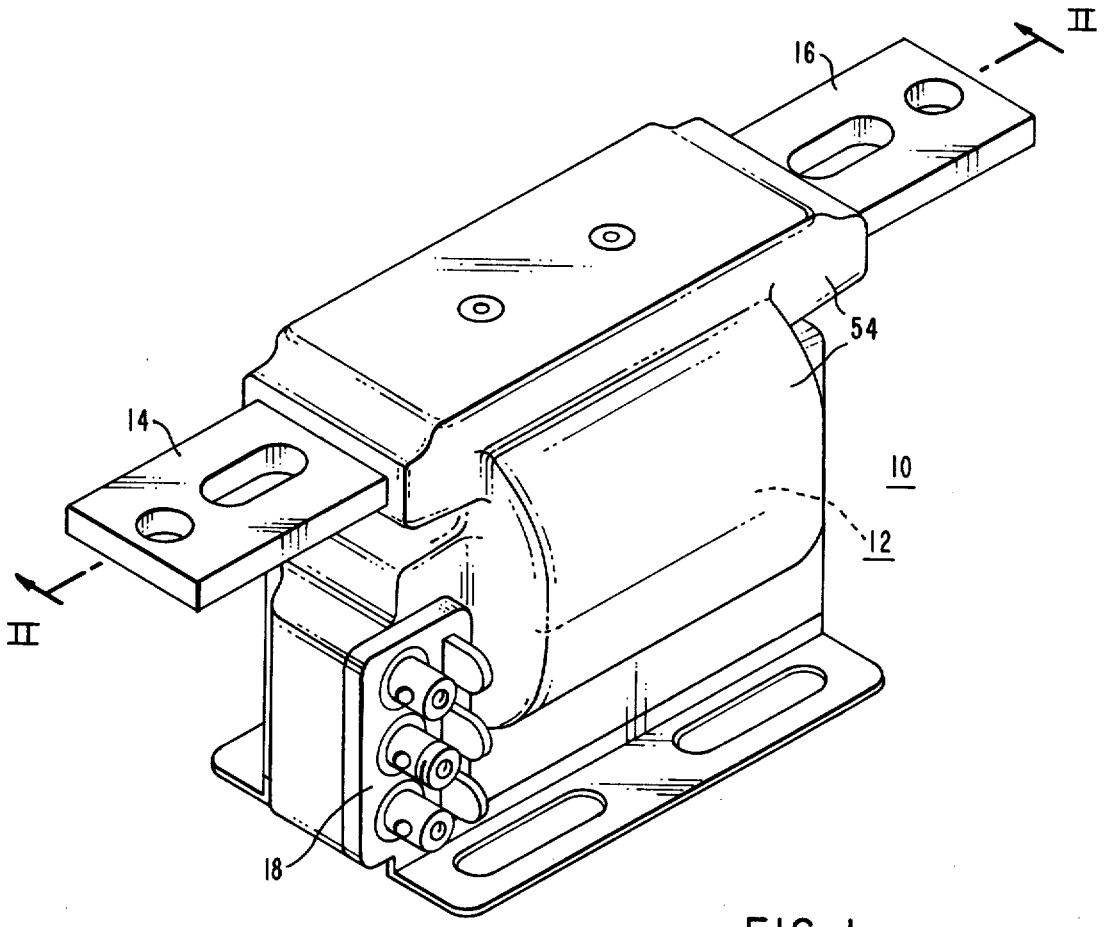
FIG. 1 is a perspective view of a current transformer constructed according to one embodiment of this invention.

Throughout the following discussion, identical reference numbers are used to refer to the same component shown in all Figures of the drawing.

Refering now to the drawing, and to FIG. 1 in particular, there is shown an instrument transformer 10, such as a current transformer, constructed according to one embodiment of this invention. The current transformer 10 includes a magnetic core and coil assembly 12 which is encapsulated in a thin layer of insulating material. The primary winding of the magnetic core and coil assembly 12 is connected to first and second terminals 14 and 16, respectively, which enables the current transformer 10 to be connected to an external electrical circuit. A secondary terminal assembly 18 provides the connections between the secondary winding of the magnetic core and coil assembly 12 and an electrical load, such as a watthour meter.

Figure 2:
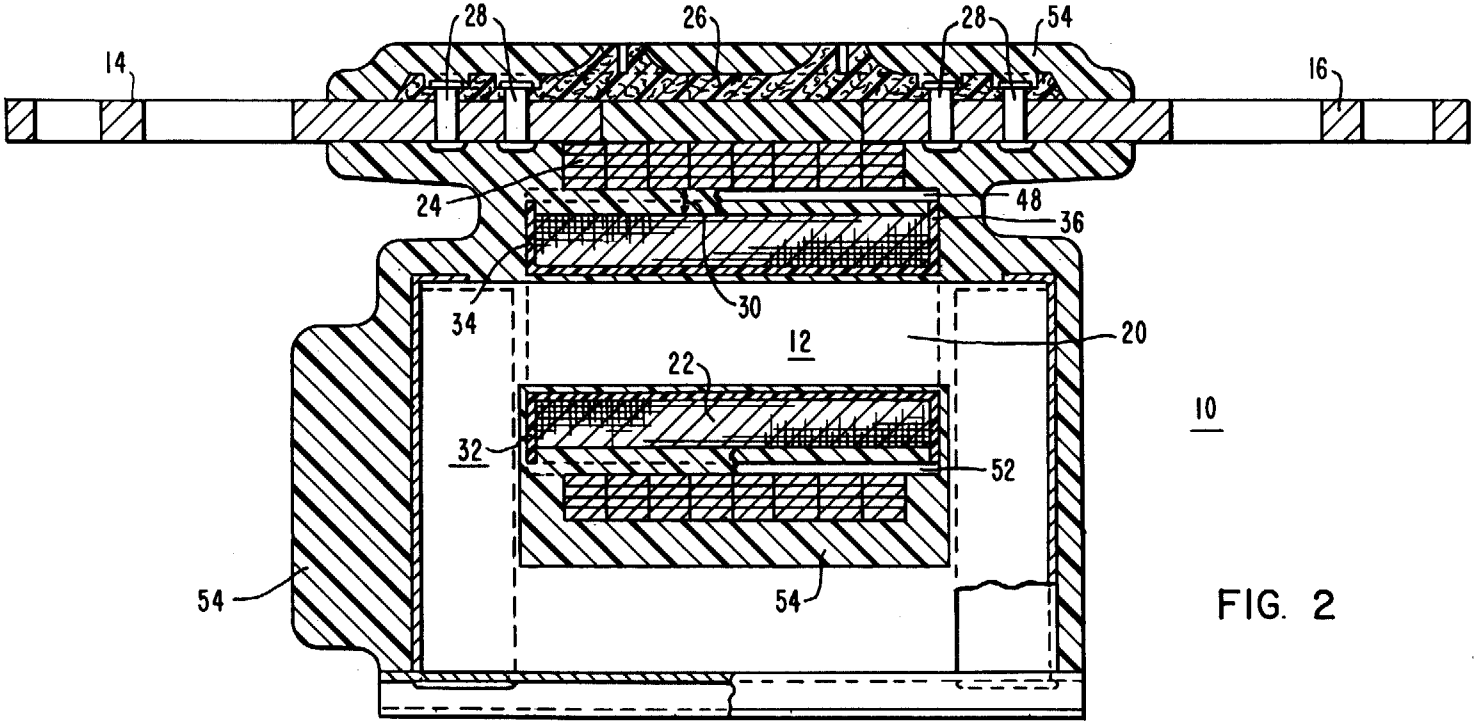
FIG. 2 is a sectional view generally taken along line II—II in FIG. 1.

Referring now to FIG. 2, there is shown a sectional view of the current transformer 10. The magnetic core and coil assembly 12 includes a magnetic core 20 which is formed of a plurality of laminations of magnetic material arranged in a substantially rectangular form. A secondary coil or winding 22 is disposed in inductive relation with a portion of the magnetic core 20 and is formed of a plurality of turns of an electrical conductor. A primary winding 24 is concentrically disposed around the secondary winding 22 so as to be inductively coupled to the magnetic core 20. The respective ends of the primary winding 24 are connected to the first and second terminals 14 and 16, respectively, by suitable joining means, such as by welding. A support member 26 is disposed between the first and second terminals 14 and 16, respectively, and is connected thereto by rivets 28 in order to maintain the first and second terminals 14 and 16 in alignment. The support member 26, according to the preferred embodiment of this invention, is formed of glass-reinforced polypropylene, the advantages of which are described in detail hereafter.

In order to provide adequate dielectric strength between the primary and secondary windings 24 and 22, respectively, an insulation space, denoted by reference number 30, must be provided. In prior art current transformers of this type, frequent misalignment of the primary and secondary windings resulted from manufacturing tolerances and the pressures involved in the molding or encapsulating process which resulted in the insulation clearance between the primary and secondary windings being below the minimum required. As a result, it was common to design an excess of insulation clearance into such current transformers in order to maintain adequate dielectric strength between the primary and secondary windings. However, this resulted in a larger mean turn of the primary winding which increased the size and cost of the current transformer.

Figure 3:
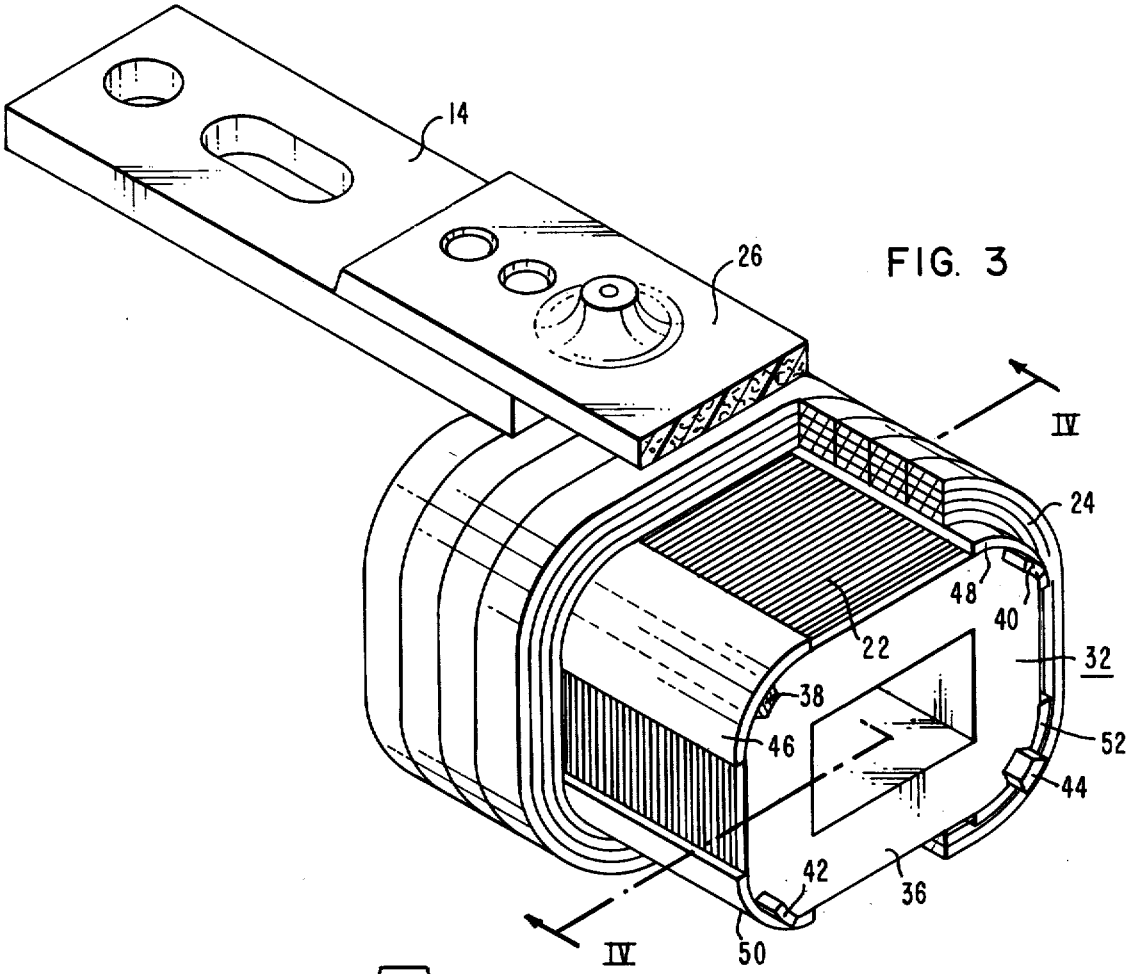
FIG. 3 is a perspective view, partially broken away, of the current transformer shown in FIG. 1.
Figure 4:
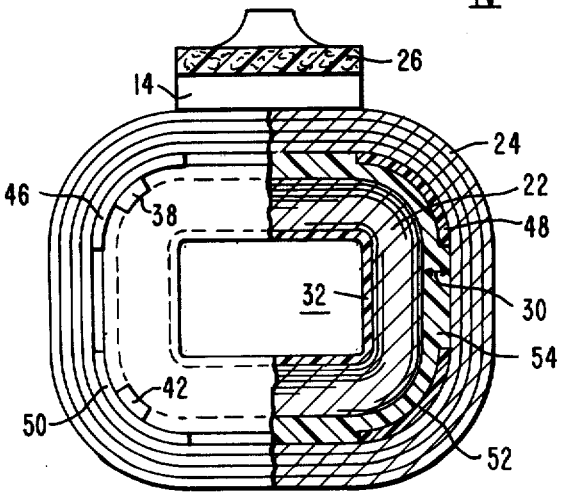
FIG. 4 is a sectional view, generally taken along line IV—IV in FIG. 3, a portion of which depicts the position of the temporary spacers prior to encapsulation, while the remaining portion illustrates the total insulation area after encapsulation.

Referring now to FIGS. 3 and 4, there is shown a novel part of this invention which fixes or maintains the insulation space between the primary and secondary windings at a constant amount despite the high pressures involved in the encapsulating process and, in particular, during an injection molding process. As shown in FIGS. 3 and 4, a winding spool 32 is provided. The winding spool 32 has a generally rectangular, tubular configuration with a rectangular opening therein such that the winding spool 32 may be disposed in close proximity with a portion of the rectangular magnetic core 20 of the current transformer 10. The winding spool 32 includes an axially extending body portion and first and second side flanges 34 and 36, respectively, which are located at the respective ends of the winding spool 32 and extend radially outwardly from the axis of the winding spool 32. In constructing the current transformer 10, the secondary winding 22 is wound around the winding spool 32 with the height or total thickness of the secondary winding 22 being slightly less than the height of the side flanges 34 and 36.

The next step in constructing the current transformer 10 depends upon the size of the conductor used in forming the primary winding 24. When relatively thin conductor is used to form the primary winding 24, the following sequence or method of construction is followed. As shown in FIG. 3, four temporary spacers 38, 40, 42, and 44 are inserted into circumferentially spaced apertures located at the corners of the side flanges 34 and 36 of the winding spool 32. The temporary spacers 38, 40, 42, and 44 extend across the entire length of the winding spool 32 and beyond the side flanges 34 and 36. Since the temporary spacers 38, 40, 42, and 44 are intended to support the primary winding as it is wound around the secondary winding 22, they are formed of relatively hard material, such as steel or "Micarta", and are disposed in registry with the outermost turns of the secondary winding 22. Next, four permanent spacers 46, 48, 50 and 52 are placed in registry with the temporary spacers 38, 40, 42, and 44, respectively, with the ends of each of the permanent spacers 46, 48, 50, and 52 contacting the outer periphery of the side flanges 34 and 36 of the winding spool 32. The permanent spacers 46, 48, 50, and 52 are thus spaced from the secondary winding 22 and are supported by the temporary spacers 38, 40, 42, and 44 during the winding of the primary coil 24 around the secondary winding 22. After the primary coil 24 has been wound around the secondary coil 22 so as to be in registry with the permanent spacers 46, 48, 50, and 52, the temporary spacers 38, 40, 42, and 44 are removed from the winding spool 32. Since the respective ends of the permanent spacers 46, 48, 50, and 52 rest on the side flanges 34 and 36 of the winding spool 32, the permanent spacers 46, 48, 50, and 52 as well as the primary winding 24 are held in fixed, spaced relationship from the secondary winding 22. Thus, the insulation clearance or space 30, as shown in FIG. 2, is maintained constant throughout the assembly of the current transformer 10.

When a relatively thick conductor is used to form the primary winding 24, it is common to wind the conductor into the primary coil 24 on a separate mandrel. Since the relatively thick conductor maintains its shape after such winding, it may be inserted as a unit over the secondary winding 22 without subjecting the secondary winding 22 and the permanent spacers 46, 48, 50, and 52 to the winding forces associated with winding the primary winding directly over the secondary winding 22. Thus, the temporary spacers 38, 40, 42, and 44 are not required. However, the end result is the same; namely, the primary winding 24 and the permanent spacers 46, 48, 50, and 52 are held in fixed spaced relationship from the secondary winding 22.

After the primary winding 24 is disposed around secondary winding 22 by either of the above-mentioned methods, the first and second terminals 14 and 16 have been connected to the primary winding 24 and the secondary terminal assembly 18 has been connected to the secondary winding 22, the entire assembly is placed in a mold having an internal cavity slightly larger than the current transformer 10. Next, an encapsulating material 54, described in detail hereafter, is injected into the mold under high pressure and temperature, which causes it to fill all of the space between the cavity of the mold and the current transformer 10 disposed therein and form a thin layer around the current transformer 10, as shown in FIG. 2. In addition, the encapsulating material 54 fills the insulation space 30 between the primary and secondary windings 24 and 22, respectively. Water cooling of the mold is then effected for a sufficient time to harden the encapsulating material 54 to a solid state which provides a weatherproof coating around the current transformer 10 as well as forming a solid layer of encapsulating material 54 in the insulation space 30 between the primary and secondary windings 24 and 22.

Since a solid layer of encapsulating material 54 fills the insulation space 30 between the primary and secondary windings 24 and 22, as shown in FIG. 4, the insulation space 30 is fixed or maintained constant. In addition, since misalignment of the primary and secondary windings 24 and 22 during the assembly of the current transformer, as was common with prior art current transformers, is eliminated, the insulation clearance 30 may be reduced to the minimum required to provide adequate dielectric strength between the primary and secondary windings 24 and 22. This results in a smaller mean turn of the primary winding 24 which accordingly reduces the overall size of the current transformer and provides a less costly unit.

According to the preferred embodiment of this invention, the material used to encapsulate the current transformer 10 consists of a thermoplastic, electrically insulating material, such as one sold commercially by the Uniroyal Company under the trade name "TPR". This compound is a thermoplastic blend of a partially cured monoolefin copolymer rubber and a polyolefin, such as polypropylene. In addition, other compounds such as one sold by The Shell Chemical Company under the tradename "Elexar", which can be injection molded and hardened to a solid state, may be used as well.

In prior art current transformers of this type, spacers formed of cellulose, fiberglass or other common insulating materials have been utilized to maintain a constant insulation clearance between the primary and secondary windings of the current transformer. However, such materials do not form an adequate bond with the types of molding materials used to encapsulate such current transformers. An interface is formed between spacers and the molding material which may trap air and create a short circuit path between the primary and secondary coils and, also, between the secondary coil and the grounded magnetic core of the current transformer. In order to overcome this problem, this invention novelly proposes to form the permanent spacers 46, 48, 50, and 52 as well as the winding spool 32 of a material which softens in the normal processing temperature range of the encapsulating material to thereby provide for fusion or amalgation between the encapsulating material and the spacers and winding spool which forms a hybrid zone without a distinct interface region therebetween. According to the preferred embodiment of this invention, the winding spool 32 and the permanent spacers 46, 48, 50, and 52 are also formed of polypropylene although other materials that soften within the normal processing temperature range of the particular encapsulating material employed, may be used as well. During the injection molding process, the temperature of the encapsulating material will be between 400° and 500° C. at the normal processing pressures. At these temperatures, the permanent spacers 46, 48, 50, and 52 and the winding spool 32 soften and fuse or amalgamate with the molding material to form a hybrid zone without a distinct interface therebetween. Thus, a short circuit path between the primary and secondary coils 24 and 22 and also between the secondary winding 22 and the grounded magnetic core 20 is eliminated.

It will be apparent that the above-described design provides sufficient support for the core and coil assembly during the high pressures encountered in the injection molding process in order to maintain a constant insulation clearance between the primary and secondary windings of the current transformer. In addition, the use of permanent spacers and winding spool formed of a material which softens within the normal processing temperature range of the encapsulating material and amalgamates with the encapsulating material to form a hybrid zone with no distinct interface therebetween provides increased dielectric strength between the primary and secondary windings of the current transformer.

Figure 5:
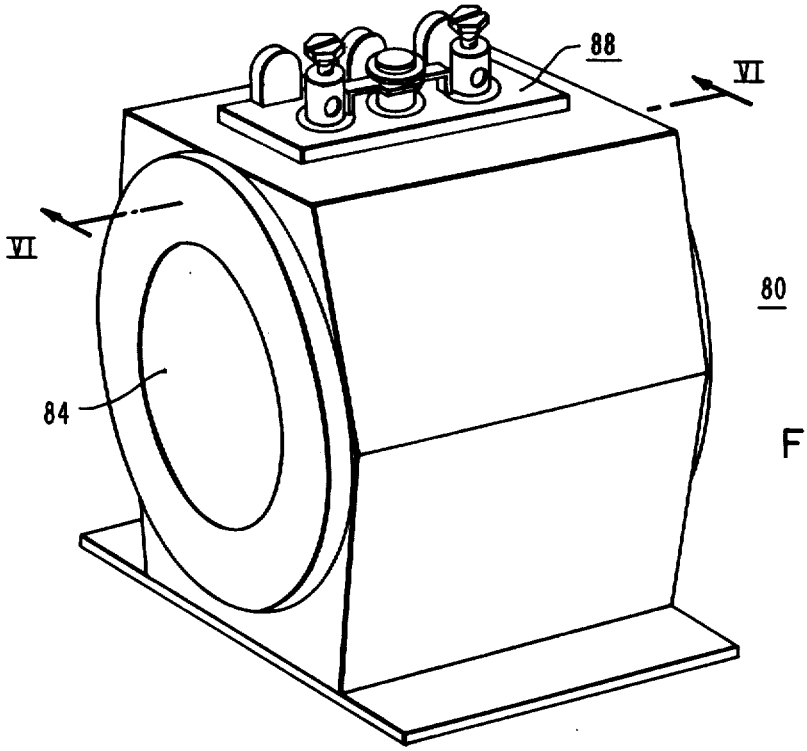
FIG. 5 is a perspective view of a current transformer constructed according to another embodiment of this invention.

Referring now to FIG. 5, there is shown a current transformer 80 constructed according to another embodiment of this invention. The current transformer 80 illustrated is known to those skilled in the art as a "through-tight" transformer. The current transformer 80 includes a magnetic core 82, shown in FIG. 6, whose laminations of magnetic material have a substantially toroidal configuration wherein a central opening 84 is formed therethrough. The central opening 84 is adapted to receive a primary conductor, such as a power line conductor. A secondary winding 85 is disposed in inductive relation around the magnetic core 82. A secondary terminal assembly 88 is connected to the ends of the secondary winding 86 and is adapted to connect the current transformer 80 to an external electrical circuit.

Figure 6:
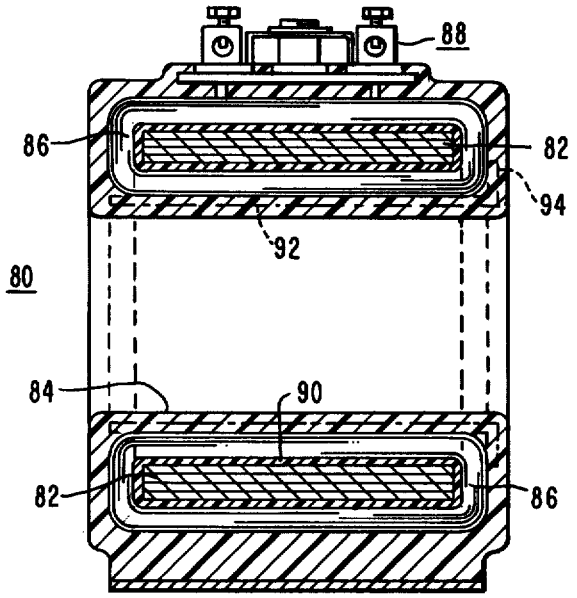
FIG. 6 is a sectional view, generally taken along line VI—VI in FIG. 5, of the current transformer shown in FIG. 5.

When attempts have been made to encapsulate current transformers having a toroidal shape by an injection molding process in the past, the high pressures involved have distorted the shape of the magnetic core and, also, caused the molding material to be extruded between the laminations thereof which decreased the electrical characteristics of the magnetic core and affected the performance of the current transformer 80. In order to provide a current transformer, such as current transformer 80, which is suitable for encapsulation by an injection molding process, it is proposed to completely coat the magnetic core 82 with a rigid material. As shown in FIG. 6, the magnetic core 82 is disposed in a rigid coat 90 of a cured thermoset resin, such as epoxy or phenolic resin, which may be applied by either a fluidized bed or electrostatic process. The resin coating 90 is cured to a hardened state and provides additional strength which resists the mechanical forces exerted on the magnetic core 82 by the high pressures involved in the injection molding process. Although coatings have been applied to magnetic cores in current transformers in the past, such coatings have been intended merely to insulate the magnetic core from the adjacent winding and, as such, do not provide sufficient strength to withstand the high forces encountered in the injection molding process.

In addition, it has been heretofore difficult to provide an adequate coating of encapsulating material on the inner surface of the central window 84 extending through the current transformer 80. Various methods, such as mechanical seals or adhesives, have been utilized in the past to provide insulation on the central opening within the current transformer. However, the use of mechanical seals, such as O-rings, are costly and bulky and adhesives have proved to be marginally effective in providing a fluid-tight seal around the central opening of the current transformer.

Accordingly, this invention provides a tubular liner 92 within the central opening 84 of the current transformer 80. The tubular liner 92 is substantially cylindrical in shape, as seen in FIG. 6, and includes a flange 94 at one end thereof which is used to support the current transformer 80 during the injection molding process. The tubular liner 92 is formed of polypropylene material, with glass fibers added thereto for additional strength. At the high pressures and temperatures associated with the injection molding process, the material forming the tubular view 92 softens and amalgamates with the encapsulating material to form a hybrid region therebetween without a distinct interface between the two materials. Since an interface or gap between the tubular liner 92 and the encapsulating material is eliminated, a previously difficult to obtain fluid-tight seal is provided.

Thus, it will be apparent to one skilled in the art that there has been herein disclosed a current transformer which is suitable for encapsulation in an injection molded layer of insulating material. In one embodiment, a plurality of permanent spacers are disposed in contact with the side flanges of the secondary winding spool to support the primary winding during the winding process and, further, to maintain the insulation clearance space between the primary and secondary windings of the current transformer at a fixed amount during subsequent processing. The permanent spacers and winding spool are formed of a material that softens within the normal processing temperatures of the encapsulating material, and forms an amalgamation therewith without a distinct interface between the encapsulating material and the permanent spacers or winding spool which provides increased dielectric strength by eliminating the short circuit path between the primary and secondary coils that frequently occurred in prior art type current transformers.

In another embodiment of this invention, a "through-type" current transformer is disclosed in which distortion of the shape of the magnetic core by the high pressures involved in the injection molding process is eliminated. The magnetic core is disposed in a rigid coating of a hardened material which prevents the distortion of the core and also prevents the molding material from being extruded between the core laminations. Furthermore, a tubular liner is disposed within the central opening of the magnetic core and is formed of a material which softens within the normal processing temperature range of the encapsulating material and amalgamates therewith without a distinct interface to form a fluid-tight seal between the tubular liner and the encapsulating material.

What is claimed is:

1. An instrument transformer comprising:

a magnetic core;

primary and secondary electrical windings concentrically disposed in inductive relation about said magnetic core;

spacer means disposed between said primary and secondary electrical windings for holding said primary and secondary windings in fixed, spaced relation; and a solid encapsulating material surrounding said magnetic core and said primary and secondary windings and filling the space between said primary and secondary windings;

said spacer means being formed of a material which softens within the normal processing temperature range of said encapsulating material so as to form an amalgamation with said encapsulating material without a distinct interface therebetween.

2. The instrument transformer of claim 1 further including:

a winding spool having an axial length and first and second ends with first and second flanges extending radially outward therefrom, respectively; and wherein the secondary winding is disposed around said winding spool to a height less than the height of said first and second flanges; and the spacer means extend across the length of said winding spool and rest on said first and second flanges so as to space the primary winding from said secondary winding.

3. The instrument transformer of claim 2 wherein the spacer means include a plurality of axially-extending rod-like members.

4. The instrument transformer of claim 2 wherein the winding spool is formed of a material which softens within the normal processing temperature range of the encapsulating material to form an amalgamation with said encapsulating material without a distinct interface therebetween.

5. The instrument transformer of claim 4 wherein the encapsulating material is a thermoplastic blend of a partially cured rubber in admixture with a polyolefin resin and the permanent spacers and the winding spool are formed, at least in part, of polypropylene.

* * * * *